United States Patent [19]

Foller et al.

[11] 4,316,782

[45] Feb. 23, 1982

[54] ELECTROLYTIC PROCESS FOR THE PRODUCTION OF OZONE

[75] Inventors: Peter C. Foller, Sunnyvale; Charles W. Tobias, Orinda, both of Calif.

[73] Assignee: Regents of the University of California, Berkeley, Calif.

[21] Appl. No.: 154,584

[22] Filed: May 29, 1980

[51] Int. Cl.[3] ..... C25B 1/00; C25B 1/04

[52] U.S. Cl. ..... 204/129

[58] Field of Search ..... 204/129

[56] References Cited

U.S. PATENT DOCUMENTS

| | | | |
|---|---|---|---|
| 3,256,164 | 6/1966 | Donohue et al. | 204/129 |
| 3,623,970 | 1/1969 | Haas | 204/129 |
| 3,947,334 | 3/1976 | Yamanouchi | 204/129 |
| 4,048,029 | 9/1971 | Seitzer | 204/129 |
| 4,107,008 | 8/1978 | Horvath | 204/129 |
| 4,131,514 | 12/1978 | Chong et al. | 204/129 |
| 4,135,995 | 1/1979 | Welch | 204/129 |

FOREIGN PATENT DOCUMENTS

| | | | |
|---|---|---|---|
| 513079 | 11/1971 | Switzerland | 204/129 |

OTHER PUBLICATIONS

The Evolution of Ozone at Lead Dioxide Anodes; Master's Thesis–Peter C. Foller.

*Primary Examiner*—Howard S. Williams

*Attorney, Agent, or Firm*—Phillips, Moore, Weissenberger, Lempio & Majestic

[57] ABSTRACT

Very high yields of ozone are produced in an electrolytic process. As high as 52% current efficiencies are secured in electrolytic cells wherein the electrolyte is water and highly electronegative anions. Anions having a so-called "composite electronegativity" of 17.5 or higher, are utilized in the electrolyte solution. The fluoroanions and in particular, the hexafluoro-anions are especially preferred. The anion producing compounds may be added to the electrolyte either in the acid form or in the form of salts. Electrolysis is carried out at room temperatures or at lower temperatures, e.g. down to the freezing point of water. Preferred anode materials for use in the electrolytic cells are either platinum or lead dioxide, especially lead dioxide in the beta crystalline form. The platinum metals, carbon, or nickel and its alloys maybe used as hydrogen-evolving cathodes. Alternately, an air or oxygen deploarized cathode may be employed which would greatly reduce the cell voltage and enhance the overall energy efficiency of the process.

12 Claims, No Drawings

ELECTROLYTIC PROCESS FOR THE PRODUCTION OF OZONE

DESCRIPTION

Technical Field

This invention relates generally to the production of ozone and more particularly to the electrolytic production of ozone utilizing highly electronegative anions in the electrolyte to greatly increase the ratio of $O_3$ to $O_2$ in the anodic gaseous product.

BACKGROUND OF THE INVENTION

Ozone has long been recognized as a useful chemical commodity valued particularly for its outstanding oxidative activity. Because of this activity it finds wide application in disinfection processes. In fact, it kills bacteria more rapidly than chlorine, it decomposes organic molecules, and removes coloration in aqueous systems. Ozonation removes cyanides, phenols, iron, manganese, and detergents. It controls slime formation in aqueous systems, yet maintains a high oxygen content in the system. Unlike chlorination, which may leave undesirable chlorinated organic residues in organic containing systems, ozonation leaves fewer potentially harmful residues. There is evidence that ozone will destroy viruses. It is used for sterilization in the brewing industry and for odor control in sewage treatment and manufacturing. And ozone is employed as a raw material in the manufacture of certain organic compounds, e.g. oleic acid and peroxyacetic acid.

Thus, ozone has wide spread application in many diverse activities, and its use would undoubtedly expand if its cost of production could be reduced. In addition, since ozone is explosive when concentrated as either a gas or liquid, or when dissolved into solvents or absorbed into gels, its transportation is potentially hazardous. Therefore, it is generally manufactured on the site where it is used. However, the cost of generating equipment, and poor energy efficiency of production has deterred its use in many applications and in many locations.

On a commercial basis, ozone is currently produced by the silent electric discharge process, wherein air or oxygen is passed through an intense, high frequency alternating current electric field. The discharge process forms ozone through the reaction:

$$3/2O_2 = O_3 \quad \Delta H^\circ_{298} = 34.1 \text{ kcal}$$

Yields in the discharge process generally range in the vicinity of 2% ozone, i.e., the exit gas may be about 2% $O_3$ by weight. Such $O_3$ concentrations, while quite poor, in an absolute sense, are still sufficiently high to furnish useable quantities of $O_3$ for the indicated commercial purposes.

Other than the aforementioned electric discharge process, there is no other commercially exploited process for producing large quantities of $O_3$.

However, $O_3$ may also be produced by the electrolytic process, wherein an electric current (normally D.C.) is impressed across electrodes immersed in an electrolyte, i.e., electrically conducting, fluid. The electrolyte includes water, which, in the process, dissociates into its respective elemental species, i.e. $O_2$ and $H_2$. Under the proper conditions, the oxygen is also evolved as the $O_3$ species. The evolution of $O_3$ may be represented as:

$$3H_2O = O_3 + 3H_2 \quad \Delta H^\circ_{298} = 207.5 \text{ kcal}$$

It will be noted that the $\Delta H^\circ$ in the electrolytic process is many times greater than that for the electric discharge process. Thus, the electrolytic process appears to be at about a six-fold disadvantage.

More specifically, to compete on an energy cost basis with the electric discharge method, an electrolytic process must yield at least a six-fold increase in ozone. Heretofore, the necessary highyields have not been realized in any foreseeably practical electrolytic system.

The evolution of $O_3$ by electroysis of various electrolytes has been known for well over 100 years. High yields up to 35% current efficiency have been noted in the literature. (Current efficiency is a measure of ozone production relative to oxygen production for given inputs of electrical current, i.e., 35% current efficiency means that under the conditions stated, the $O_2$-$O_3$ gases evolved at the anode are comprised of 35% $O_3$ by volume). However such yields could only be achieved utilizing very low electrolyte temperatures, e.g. in the range of $-30°$ to $-65°$ C. Maintaining the necessary low temperatures, obviously requires costly refrigeration equipment as well as the attendant additional energy costs of operation.

An electrolytic process for the production of $O_3$ has now been devised which greatly increases the production efficiency of $O_3$ to an extent sufficiently high to compete with the prior art electric discharge process.

DISCLOSURE OF THE INVENTION

The present invention provides an electrolytic process for the production of $O_3$. The invented process yields $O_3$ with very high current efficiencies, in some instances as high as 52%. Such current efficiencies are achieved by employing very highly electronegative anion constituents in the electrolyte. The fluoro-anions are among the most electronegative of all anions. The hexafluoroanions are most preferred, and in particular, the hexafluoro anions of phosphorus, arsenic, and silicon. The ozone is produced in an electrolytic cell utilizing an electrolyte consisting of water and the acids or salts of the fluoro-anions dissolved therein. The fluoro-anion electrolytes are capable of producing high yields of $O_3$ in the practice of the invention method.

The electrolytic cells employ conventional techniques in their construction, taking into account the corrosive nature of the electrolytes. However, as will be subsequently disclosed, careful selection of anode materials is advisable to maximize the advantage of the hexafluoro-anion electrolytes. The proper anodes substantially contribute to the high yields of $O_3$ from the cells. Proper selection of electrode materials also minimizes current consumption for a given $O_3$ yield, and reduces deterioration of the electrodes from the corrosive action of the electrolytes.

In addition, the process of the invention, unlike previous $O_3$ electrolytic processes, may be carried out at ambient or only slightly lower temperatures, and no special refrigeration of the cells is required.

Power requirements and current densities are well within conventional electrolytic cell practice.

In somewhat more detail, $O_3$ in high relative yield, is produced from electrolytic cells of conventional construction. Anodes of platinum or lead dioxide are most preferred. Cathodes of platinum, nickel, carbon, or materials coated with the platinum metals i.e., those materials exhibiting low hydrogen overvoltages are preferred if hydrogen is to be evolved as the cathodic process. Alternately, oxygen may be reduced at an air or oxygen depolarized cathode. (Substantial savings in cell voltage would result.)

The cell electrolyte is of crucial importance. In particular, highly electronegative fluoro-anions, having a "composite electronegativity" (as is subsequently defined) of perhaps 17.5 or greater and particularly the hexafluoro-anions of phosphorus, arsenic, and silicon, are preferred.

The electrolyte consists of an aqueous solution of the highly electronegative anions and any suitable cationic component, most usually the acid form of the anion, i.e., $H^+A^-$; or a cation of the soluble salts thereof, e.g., alkali metals, especially $Na^+$, which is usually the most soluble.

A D.C. current is impressed across the cell electrodes in the usual manner, whereby a mixture of $O_2$ and $O_3$ gas is generated at the anode and $H_2$ is generated at the cathode.

DETAILED DESCRIPTION OF THE INVENTION

According to the method of the invention, $O_3$ is produced in high current efficiency, by electrolyzing water in an electrolytic cell wherein anions of very high electronegativity are added to the aqueous electrolyte.

The added highly electronegative anions and their accompanying cations first serve to carry an electric current between the electrodes of the cell, since water itself, the major component of the electrolyte is essentially non-conducting. Secondly, the added highly electronegative anions greatly increase the production of $O_3$ at the cell anode at the expense of $O_2$ which normally results when water is electrolytically decomposed.

The mechanism whereby $O_3$ is produced at the expense of $O_2$ is not fully understood, however, it undoubtedly is influenced by a number of factors including such considerations as the anion's ability to stabilize cationic species formed intermediate to the $O_3$ formation process; and the anion's ability to absorb upon the surface of the anode to a limited and ideal extent during the electrolytic process. Whatever the mechanism, it has been found that when highly electronegative anions are admixed with water in an electrolytic cell, the production of $O_3$ in relation to $O_2$ is significantly improved. Not only is the $O_3/O_2$ ratio greatly improved, but the cell components, including the electrolyte, need not be refrigerated to temperatures below the freezing point of water as has been the case with some prior art methods.

The electrolyte should comprise a solution of the highly electronegative anions (and their accompanying cations) dissolved in water.

It is desirable that the anions be as electronegative as possible i.e., have a "composite electronegativity," as will subsequently be defined, of at least 17.5, and for this purpose, the fluoroanions are eminently suitable. Fluorine is the most electronegative of all of the elements. Fluorine has the further capability of complexing with other elements of the periodic table to form the most highly electronegative anions known. The group V-A elements of the periodic table, phosphorus and arsenic form particularly desirable hexafluoro-anions. Other related non-metallic elements, such as silicon and antimony also form hexafluoro-anions. The phosphorus, arsenic, boron ($BF_4$-) and silicon fluoro-anions are the preferred anions for addition to the aqueous electrolyte for the method of the invention. (Other members of the fluoro-anion class include $PO_2F_2^-$, $HTiF_6^-$, $NbF_7^{--}$, $TaF_7^{--}$, $NiF_6^{--}$, $ZrF_6^{--}$, $GeF_6^{--}$, $FeF_6^{--}$, and the polyhalogenated boranes.)

The antimony hexafluoro-anion demonstrates anomalously low ozone yields when utilized in the method of the invention. It is believed that this anomaly occurs because of the fact that antimony hexafluoride-anion solutions dimerize to form $Sb_2F_{11}^-$ ions. The dimerized antimony hexafluoride-anions have an extremely high composite electronegativity of 46.0 ($SbF_6^-$ being 26.0). The dimerized anion has an enormous electron withdrawing power and it is believed that its extremely high electronegativity totally stabilizes an intermediate cationic species and so effectively inhibits ozone formation.

In any event, with the exception of the antimony hexafluoro-anion, the remaining group V-A elements, P and As, as well as Si hexafluoro-anions and the $BF_4^-$ ion are most preferred for use in the electrolytes.

Both the arsenic hexafluoro-anion the silicon hexafluoro-anion and the tetrafluorborate ion promote very high ozone yields when utilized in the present invention. However, the most preferred is the phosphorous hexafluoro-anion which achieves outstandingly high ozone yields.

The fluoro-anions may be added to the aqueous electrolyte solution either in the form of their respective acids or as water soluble salts. While the acid form of the fluoro-anions may be preferred because of their higher solubilities in water, it may at times be desirable to utilize the fluoro-anion salts e.g. of sodium or potassium, since aqueous solutions thereof produce higher pH's than does the acid form. As will be noted hereinafter, corrosion of the cell electrodes can be a problem because of the low pH and extremely corrosive nature of the fluoro-anions. Therefore in the event that corrosion problems become excessive, the alkali metal salts of the hexafluoro-anions may be utilized to increase the pH and thereby alleviate electrode corrosion. Alternately, mixtures of the aforementioned anions may be utilized in order to maximize ozone yield, while minimizing corrosion problems.

On the other hand, the reduced solubility of the salts of the hexafluoro-anion can also lead to reduced ozone yields and the concurrent reduction of ozone yields must be balanced against reduced electrode corrosion when the salts are utilized in the electrolyte solutions.

A measure of the "composite electronegativity" of the fluoro-anions utilized in the present invention can be calculated from compilations of the electronegativity of the various elements which can be found in any standard work on inorganic and/or electrochemistry. The value of the electronegativity of any of the anions is calculated, on a per charge basis, as the absolute value of a direct summation of atomic electronegativities. Thus, the atomic electronegativity of fluorine is $-4.0$; phosphorus is $-2.1$; arsenic is $-2.0$; silicon is $-1.8$; antimony is $-1.8$, and hydrogen is $+1.7$. By simple summation the "composite electronegativity" of the $PF_6^-$ anion is 26.1; $AsF_6^-$ is 26.0; $SbF_6^-$ is 25.8; and $HSiF_6^-$ is 24.1. The "compositive electronegativity" of the phosphorus fluoro-anion is the highest of those hexafluoro-anions noted, and its use in the electrolytic process of the invention results in the highest $O_3$ current efficiences.

As will be noted subsequently, ozone current efficiencies are generally in accordance with the composite electronegativity of the anions utilized in the electrolytes. As noted previously, the antimony hexafluoro-anion is an exception to the rule, apparently for the reasons noted.

In any event, the highly electronegative anions either in the acid or salt form, are dissolved in water to form the electrolyte for use in the method of the invention.

From an ozone current efficiency standpoint, it is desirable to increase the fluoro-anion concentration in the electrolyte to the maximum of solubility. Increasing the anion concentration in the electrolyte, increases the ozone current efficiency in all instances. It should be borne in mind, however, that as the anion concentration increases, problems associated with electrode corrosion also increase to the extent that reductions of anion concentration below the maximum possible may be desirable. In any event, however, increasing anion concentration results in increasing ozone current efficiency.

As an illustration of the effect of anion concentration on ozone current efficiency, some tests were conducted utilizing various concentrations of $HPF_6$ in a cell having a $PbO_2$ anode. At a 2.25 molar concentration, ozone was produced in as high as 21% current efficiency. At 5 molar concentration, ozone was produced in a current efficiency of as high as 34%. At 7.3 molar concentration (maximum solubility of commercially available $HPF_6$) ozone was produced at slightly over 50% current efficiency. However, at the 7.3 molar concentration the anode potentials measured were very high and erratic.

When platinum anodes were substituted for the lead dioxide anodes, the same trend of increased concentration leading to increased current efficiency was observed. For instance, at a 3 molar concentration, ozone was produced in slightly under 10% current efficiency. On the other hand, at the 7.3 molar concentration, ozone was produced in slightly greater than 50% current efficiency. Similar results were observed in the case of the related fluoro-anions.

Unlike prior art ozone electrolytic production processes, the electrolysis utilizing the present invention method may be conducted at ambient or moderately lower temperatures. Of course, the passage of electrical current through the cell results in heating effects on the electrolyte and the cell components. It is therefore desirable to provide some cooling of the electrolyte and the cell electrodes. For this purpose, the electrolyte may be circulated to an external heat exchanger in order to maintain its temperature at or slightly below ambient temperatures. In most circumstances, water as it is secured from the water main is sufficient to maintain the electrolyte at or slightly below ambient temperatures. Similarly, provisions may be made for admitting cold water through internal passages within the electrode structures to maintain the electrodes themselves at ambient or slightly below ambient temperatures.

Slightly refrigerated coolants may be supplied to the heat exchangers or to the internal passages within the electrodes so that the electrolysis can proceed at temperatures from ambient and ranging down to 0° C. Increase in current efficiency of ozone production may be realized by cooling the cell and its electrolyte below the noted temperatures, but energy penalties of such refrigeration will result.

Proper selection of the electrolytic cell electrodes is very important to maximize ozone yields.

It will be understood that when practicing the method of the invention, hydrogen may be produced at the cell cathode. Conventional cathode materials may be utilized taking into account the corrosive nature of acid solutions of the electrolyte as well as the advantage in employing materials which exhibit low hydrogen overvoltages. Utilizing the above criteria, it will be understood that conventional cathode materials for hydrogen evolution such as platinum, carbon, platinized metals and/or nickel are satisfactory for use as the cell cathodes. Alternately an air or oxygen depolarized cathode could be used. The reaction at this cathode would be:

$$O_2+4H^++4e^-\rightarrow 2H_2O.$$

There are several advantages to the incorporation of an air cathode into the process. They are:

(1) The cell voltage would be substantially reduced. Replacing hydrogen evolution with the reduction of oxygen theoretically saves 1.23 v. (In actual practice a 0.8 v swing is likely to be achieved.)

(2) A separator between anode and cathode is no longer required, as no hydrogen is evolved to depolarize the anode. Further, savings in cell voltage result as I-R losses are reduced.

(3) The overall cell process becomes oxygen in and ozone out. The need for periodic additions of water is reduced.

(4) The same air (or oxygen) fed to the air cathode could also serve to dilute and carry off the ozone that is anodically evolved by flowing through the cathode.

Air cathode technology is highly developed due to recent interest in its application to fuel cells, metal-air batteries, and the chlor-alkali industry. The electrodes are generally composed of teflon-bonded carbon containing small amounts of catalytic materials. The cathodes may be readily purchased. Their incorporation into a process for ozone manufacture is regarded as little problem.

On the other hand, the selection of anode materials is quite important to the maximization of ozone production. The anode material must be stable to strong anodic polarization that is, it must be in its highest oxidation state, or be kinetically resistant to further oxidation. Further the anode must be highly conductive in order to handle the current densities needed to achieve a sufficient anodic potential for ozone formation. The anode material must also be stable to the high interfacial acid concentrations produced by anodic discharge of water as well as the chemically corrosive nature of the highly electronegative anions. It has been determined that two materials eminently satisfy the criteria for anodes. These materials are platinum metal and lead dioxide, especially lead dioxide in the beta-crystalline form.

Electrolysis cells in which the production of the ozone is carried out may follow standard technology taking into consideration the corrosive nature of the fluoro-anion electrolytes and the high oxidizing power of the ozone gases. As oxygen and ozone are produced at the cell anode when hydrogen is produced at the cell cathode, additional precautions must be taken to ensure the separation of the cathode gases from the anode gases. Providing for the above-noted considerations, however, is well within current cell technology. If, however, oxygen is reduced as the cathodic process no such separation is necessary.

More specifically, the electrolysis cell chamber should be constructed of materials which are inert to the highly corrosive electrolyte. The chamber should therefore be coated with inert polymeric materials, perhaps even polyfluorinated polymers e.g. Teflon, which is resistant to oxidizing gases and has an excellent resistance to highly acid and corrosive solutions.

Provisions must also be made for separating the anode compartment of the cell chamber from the cathode compartment in order to fully separate the hydrogen evolved at the cathode (if this cathodic reaction is chosen) from the gases evolved at the anode. Such separators are well known in the art, with a particularly useful separator being constructed of "Nafion" a perfluorinated polymeric ion exchange material which is available from E. I. Dupont. Membranes of such material, while forming a liquid and gas barrier, permit electric current flow between electrolytes or electrodes in contact with the two sides of the Nafion. Provision of such a barrier or similar barriers prevents interaction of the electrode gases. Such a separator is not needed if oxygen is to be reduced in the cathodic process.

Incorporation of such a membrane as Nafion may be advantageous for a second reason. The cell electrodes may be pressed against it, thus minimizing the inter-electrode gap, resulting in reduced ohmic losses during electrolysis. Such a measure would increase the overall energy efficiency of the electrolysis. In such a practice, the electrodes might consist of fine wire meshes or powdered materials held in place by wire meshes. Water flows in from the back side of the mesh and is decomposed on its surface. The fluori-anion necessary for efficient ozone evolution is supplied by this electrolyte. The anodic and cathodic gases also escape through the back of the mesh electrodes. This "solid polymer electrolyte" (S.P.E.) technology has been fully developed by General Electric Corp. as applied to fuel cells and to water electrolysis (producing hydrogen and oxygen). The concept is also applicable to electrolytic ozone generation.

Electrodes for use in the cells, whether in conventional or S.P.E. geometry must be carefully selected; with special care being given to the selection of the anode materials.

As noted, if hydrogen is to be evolved at the cell cathode, any cathode material which exhibits resistance to acidic electrolytes and which has a low hydrogen overvoltage is suitable. For instance, the platinum metals, nickel or carbon may be used. In addition, materials coated with the platinum metals may be utilized for the cell cathode. If oxygen is to be reduced, teflon-bonded carbon porous electrodes are used. These may be catalyzed with the platinum metals, or certain oxides.

The selection of the anode material on the other hand, is much more critical to the successful operation of an ozone electrolysis cell. It has been determined that several materials demonstrate excellent performance as anode materials in the presence of the highly electronegative fluoro-anion electrolytes. These materials are platinum metal and the two crystalline forms of lead dioxide.

Ozone current efficiencies in cells utilizing platinum anodes are quite excellent; and in addition, the platinum electrodes are relatively inert to the corrosive effects of the fluoro-anion electrolytes. Anodes constructed of lead dioxide, and specifically lead dioxide in the beta-crystalline form, demonstrate even higher ozone current efficiencies than do platinum anodes. On the other hand, lead dioxide anodes are more susceptible than platinum to the corrosive effects of highly concentrated fluoro-anion electrolytes. Thus, the selection of either platinum or lead dioxide anodes is most advantageously determined by the desirability of the highest ozone current efficiencies expected from the cell in contrast to the rapidity with which the anode is corroded by the particular electrolyte under utilization. If extremely high ozone current efficiency is desired and corrosion of the anode is a secondary consideration, then the logical anode material would be lead dioxide in the beta-crystalline form. On the other hand, if the highest ozone current efficiency is not of prime importance, but anode durability is, then the logical anode material would be platinum. Obviously, the cost of anode materials may also be important and the economics of cell materials is also a factor to be considered.

In any event, both platinum and lead dioxide (especially are the beta-crystalline form) are excellent materials for the anode in the electrolytic cells of the present invention. Platinum has traditionally been used in investigations of the ozone evolution process. Even at current densities of ten's of amperes per square centimeter, the platinum electrode experiences minimal weight loss. A protective film of $PtO/PtO_2$ prevents further oxidation of the electrode material. Also, the oxygen overvoltage on bright platinum is among the highest observed. As will be noted subsequently, ozone current efficiencies utilizing platinum anodes are quite excellent at all current densities and electrolyte concentrations.

However, ozone current efficiencies in cells utilizing lead dioxide anodes are consistently higher than in those using platinum anodes. Beta lead dioxide anodes give superior yields in all electrolyte systems at ordinary current densities at near ambient temperatures.

Lead dioxide has two common crystalline forms, denoted as alpha and beta. Either crystalline structure may be electrodeposited on a suitable substrate in a pure, glassy form by controlling the pH, temperature and current density in the deposition process. For the purposes of the present invention, the beta crystalline form is more highly desired than the alpha crystalline form.

The beta crystalline form of lead dioxide is a tetragonal rutile structure of unit cell dimensions 3.8, 4.94 and 4.94 angstroms. Beta lead dioxide has a higher oxygen overvoltage than alpha lead dioxide and in fact, has a greater overvoltage than that of platinum. Cells with beta lead dioxide anodes give the highest yields of ozone of any anode material, in all electrolyte systems studied at near ambient temperatures.

Lead dioxide anodes for use in the electrolytic cells of the invention may be prepared as follows:

Lead dioxide is deposited anodically which limits the choice of substrate materials. Most metals dissolve when the deposition is attempted. However, the noble metals, carbon, titanium, and tantalum, are suitable as substrates for the anodes.

Titanium and tantalum when utilized as substrate materials are first platinized to eliminate passivation problems sometimes encountered with the uncoated substrates.

Carbon may be utilized as a substrate, however, lead dioxide adherence is a particular problem if the carbon has not been thoroughly degassed. The carbon is degassed by boiling in water for some time followed by vacuum drying over a period of days. When degassed, adherence is greatly improved with respect to thermal stress. Vitreous or glassy carbon does not appear to have the adherence problem. Vitreous or glassy carbon may make a good choice for anode substrate material.

Platinum is the most convenient substrate material to work with, gives most uniform deposits, and does not present any additional problems. Thus it is the most suitable substrate material for lead dioxide anodes. However, its high cost may make other previously mentioned substrate materials more practical for commercial use.

In any event, lead dioxide is plated onto substrates from a well known plating bath comprising essentially lead nitrate, sodium perchlorate, copper nitrate, and a small amount of sodium fluoride and water. The substrate material is set up as the anode in a plating bath. The pH of the bath is maintained between 2 and 4. Current densities of between 16 and 32 miliamperes per square centimeter give bright smooth and adherent lead dioxide deposits. Bath temperature is most usually maintained at about 60° C. at all times during deposition. The deposition is carried out with vigorous stirring of the electrolyte and rapid mechanical vibration of the anode to give consistently finely granular deposits free from pinholes or nodules. A surface active agent may be added to the plating solution to reduce the liklihood of gas bubbles sticking to the anode surface.

By such method as noted above, excellent beta lead dioxide anodes may be prepared for use in the cells of the invention.

The cathode and anode are positioned within the electrolytic cell with electrical leads leading to the exterior. The cell is also provided with appropriate plumbing and external structures to permit circulation of the electrolyte to a separate heat exchanger. Suitable inlet and outlet passages are also provided in the cell head space to permit the withdrawal of the gasses evolved from the cathode (if hydrogen is to be evolved) and from the anode. The two gas removal systems are maintained separate in order to isolate the cathode gases (when hydrogen is chosen to be evolved) from the anode gases. Nitrogen and/or air may be pumped through the gas handling system in order to entrain the evolved cathode and anode gases and carry then from the cell to the exterior where they may be utilized in the desired application. Alternately, if a flow-through air (or oxygen) cathode is employed, its excess gases may be used for this purpose.

In order to maintain or cool the cell electrodes, heat exchange passages may be provided within the electrode structures. These coolant passages are connected to external sources of coolant liquid which can be circulated through the electrodes during the electrolysis process in order to maintain or reduce their temperatures.

The electrodes through the electrical leads are connected to an external source of electric power with, of course, the polarity being selected to induce the electrolyte anion flow to the anode and cation flow to the cathode.

In order to drive the electrolysis reaction, it is necessary to apply electric power to the cell electrodes. The power requirements are not appreciably different for those cells utilizing platinum anodes from those cells utilizing lead dioxide anodes. Electrical potentials in the order of from 2–3 volts D.C. are quite sufficient for the various cell configurations. The current requirements are most easily measured in the terms of current density and may vary from a low of perhaps a tenth of an ampere per square centimeter up to densities slightly beyond one ampere per square centimeter. The power requirements are not necessarily dependent upon the electrolyte concentrations, nor in particular upon the anode materials. Thus current densities of from about 0.1 $A/cm^2$ to about 1.5 $A/cm^2$ will produce maximum ozone current efficiencies at any electrolyte concentration with either beta lead dioxide anodes or platinum anodes.

There is some rise time necessary to produce maximum ozone current efficiencies subsequent to start up of the electrolytic process. In the case of platinum anodes the rise-time to maximum ozone yield is about 30 minutes. Lead dioxide anodes on the other hand, require perhaps 90 minutes to reach maximum ozone production.

Ozone current efficiencies were determined utilizing electrolytes, anodes, currents, in accordance with the invention, were determined in a series of tests.

The results of these tests are set forth in Table 1 below:

TABLE I

| ELECTROLYTE | CONCENTRATION | ANODE MATERIAL | CELL TEMP. | RANGE OF CURRENT DENSITIES | MAXIMUM OZONE CURRENT EFFICIENCY |
|---|---|---|---|---|---|
| $HPF_6$ | 2.25M | $\beta$-$PbO_2$ | 0° C. | 0.4–1.2A/$cm^3$ | 21% |
| $HPF_6$ | 5 M | $\beta$-$PbO_2$ | 0° C. | 0.2–1.0A/$cm^2$ | 34% |
| $HPF_6$ | 7.3M | $\beta$-$PbO_2$ | 0° C. | 0.4–0.6A/$cm^2$ | 52% |
| $HPF_6$ | 3 M | Pt | 0° C. | 0.3–1.0A/$cm^2$ | 10% |
| $HPF_6$ | 7.3M | Pt | 0° C. | 0.4–0.6A/$cm^2$ | 52% |
| $H_2SiF_6$ | 2 M | $\beta$-$PbO_2$ | 0° C. | 0.2–0.8A/$cm^2$ | 13% |
| $HAsF_6$ | 2 M | $\beta$-$PbO_2$ | 0° C. | 0.2–0.8A/$cm^2$ | 15.5% |
| $HBF_4$ | 4 M | $\beta$-$PbO_2$ | 0° C. | 0.2–0.8A$cm^2$ | 18.0% |
| $HBF_4$ | 7.3M | $\beta$-$PbO_2$ | 0° C. | 0.2–1.2A/$cm^2$ | 16.5% |
| $NaBF_4$ | 4 M | $\beta$-$PbO_2$ | 0° C. | 0.3–1.2A/$cm^2$ | 13% |

As will be noted from the results above, ozone can be produced at current efficiencies above 50% in electrolytic cells having either lead dioxide or platinum anodes and utilizing hexafluorophosphate-anion electrolyte.

Other aspects, objects and advantages of this invention will be noted from a study of the disclosure and the appended claims.

We claim:

1. A method of improving the yield of ozone in relation to the yield of oxygen from the anodic decomposition of water in aqueous electrolytes comprising admixing hexafluoro-anions with the water.

2. The method of claim 1 wherein the hexafluoro-anions are in the acid form.

3. The method of claim 1 wherein the hexafluoro-anions are in the form of a water soluble salt.

4. The method of claim 3 wherein the soluble salt is an alkali metal salt.

5. The method of claim 1 wherein the hexafluoro-anions are selected from the group of $PF_6^-$, $AsF_6^-$, and $HSiF_6^-$ and mixtures thereof.

6. The method of claim 1 wherein the anode is platinum.

7. The method of claim 1 wherein the anode is $PbO_2$.

8. The method of claim 7 wherein the $PbO_2$ anode is in the beta crystalline form.

9. The method of claim 1 wherein the water and admixed hexafluoro-anions electrolyte is electrolyed in the presence of an air or oxygen depolarized cathode.

10. An electrolyte useful for producing relatively high yields of ozone in relation to oxygen in an electrolytic cell, comprising water and very highly electronegative hexafluoro-anions dissolved therein.

11. The electrolyte of claim 10 wherein the hexafluoro-anions are selected from the group, $PF_6^-$, $AsF_6^-$, and $HSiF_6^-$ and mixtures thereof.

12. A method for producing ozone at high current efficiencies from an electrolytic cell comprising passing an electric current through an electrolyte comprising water and hexafluoro-anions dissolved therein.

* * * * *